United States Patent [19]

Holbrook

[11] Patent Number: 4,978,114

[45] Date of Patent: Dec. 18, 1990

[54] REVERSE BELT SINGULATING APPARATUS

[75] Inventor: Russell W. Holbrook, Middlebury, Conn.

[73] Assignee: Pitney Bowes Inc., Stamford, Conn.

[21] Appl. No.: 435,912

[22] Filed: Nov. 14, 1989

[51] Int. Cl.[5] ..... B65H 3/52; B65H 3/04

[52] U.S. Cl. ..... 271/35; 271/122; 271/262

[58] Field of Search ..... 271/10, 122, 121, 124, 271/125, 35, 34, 137, 262, 263

[56] References Cited

U.S. PATENT DOCUMENTS

| | | | |
|---|---|---|---|
| 1,955,066 | 4/1934 | Hiller | 271/35 |
| 3,339,917 | 9/1967 | Petrovsky . | |
| 3,970,298 | 7/1976 | Irvine et al. | 271/34 |
| 4,085,929 | 4/1978 | Tuchiya et al. | 271/122 |
| 4,216,952 | 8/1980 | McInerny | 271/10 |
| 4,416,449 | 11/1983 | McInerny | 271/122 |
| 4,436,298 | 3/1984 | Donner et al. | 271/10 |
| 4,500,084 | 2/1985 | McInerny | 271/35 |

FOREIGN PATENT DOCUMENTS

| | | | |
|---|---|---|---|
| 51433 | 3/1986 | Japan | 271/122 |
| 291340 | 12/1986 | Japan | 271/122 |

*Primary Examiner*—David H. Bollinger

*Attorney, Agent, or Firm*—Charles G. Parks, Jr.; David E. Pitchenik; Melvin J. Scolnick

[57] ABSTRACT

The reverse belt drive assembly is mounted to an envelope feeding apparatus. The envelope feeding apparatus includes a deck along which sheet member is caused to traverse by a drive assembly. The reverse belt drive assembly includes a first frame pivotally mounted to the apparatus above the deck and drive assembly. The first frame rotatively supporting a plurality of first and second rollers such that respective ones of the first and second rollers are in longitudinal spaced apart relationship. A first endless belt extends around respective ones of the first and second rollers. A second frame is pivotally mounted to the first frame. The second frame rotatively supporting a plurality of third rollers axially aligned to the first rollers and a plurality of fourth rollers, respective one of the third and fourth rollers being in longitudinal spaced apart relationship and having a second endless belt extending around respective ones of the third and fourth rollers. A plurality of springs biasing the first and second frame members downwardly against the deck. A motor drives the rollers to rotate in a direction opposite to the drive assembly.

13 Claims, 5 Drawing Sheets

REVERSE BELT SINGULATING APPARATUS

BACKGROUND OF THE INVENTION

The present invention relates to singulating devices whereby a stack of sheet members, such as envelopes, are received by the device and, in a seriatim manner, a single envelope is withdrawn from the stack for downstream processing.

It is the objective of singulating sheet-feeding devices within a mail processing environment to efficiently withdraw the bottom most envelope from an envelope stack employing a singulating apparatus and either transport or hand-off the bottom most envelope for further processing. The efficiency of the singulating process is expressed in terms of the ability of the singulating apparatus to consistently singulate envelopes as a function of variation in envelope stack height and stack composition. Envelope stack composition refers to the degree of permissible variability between the individual envelope as to size and thickness.

It is known to provide such devices with a stack receiving tray. The tray generally includes forward urging rollers which act on the bottom most envelope. Because of the pressure applied to the bottom most envelopes by the weight of the envelope stack, thereby, increasing the friction forces between the bottom envelopes, it is known to provide a reverse belt assembly for overcoming the friction load of the bottom envelopes. In order to provide efficient singulation of the envelope stack, it is common to limit the stack size such that the developed friction forces between the bottom most envelopes does not exceed the separation force applied by the reverse belt assembly.

SUMMARY OF THE PRESENT INVENTION

It is an object of the present invention to present a reverse belt assembly which cooperates with a forward drive assembly to more efficiently singulate a sheet-member such as an envelope from a member stack. The reverse belt assembly cooperates with the forward drive assembly such that singulating efficiency is substantially increased.

An envelope feeder includes a receiving tray to receive a stack of envelopes. The receiving tray includes a plurality of motor driven rollers for urging the bottom most envelopes into a singulator station. The singulator station includes a forward drive belt assembly which is mounted to the feeder deck providing a downstream drive force to the bottom envelopes. Located above a forward belt drive is a reverse belt drive assembly. The reverse belt drive is comprised of a first pivot frame rotatably supporting a plurality of rollers having a first belt extending around respective roller sets for preshingling a portion of bottom group of envelopes. A second frame assembly is pivotally mounted to the first pivot frame for generally independent pivotal motion. The second frame rotatably supports a plurality of rollers having a second belt extending around a respective roller set. A drive motor causes the first and second belts to displace in a reverse direction to the forward belt drive.

DETAILED DESCRIPTION OF THE PREFERRED EMBODIMENT

Figure 1:
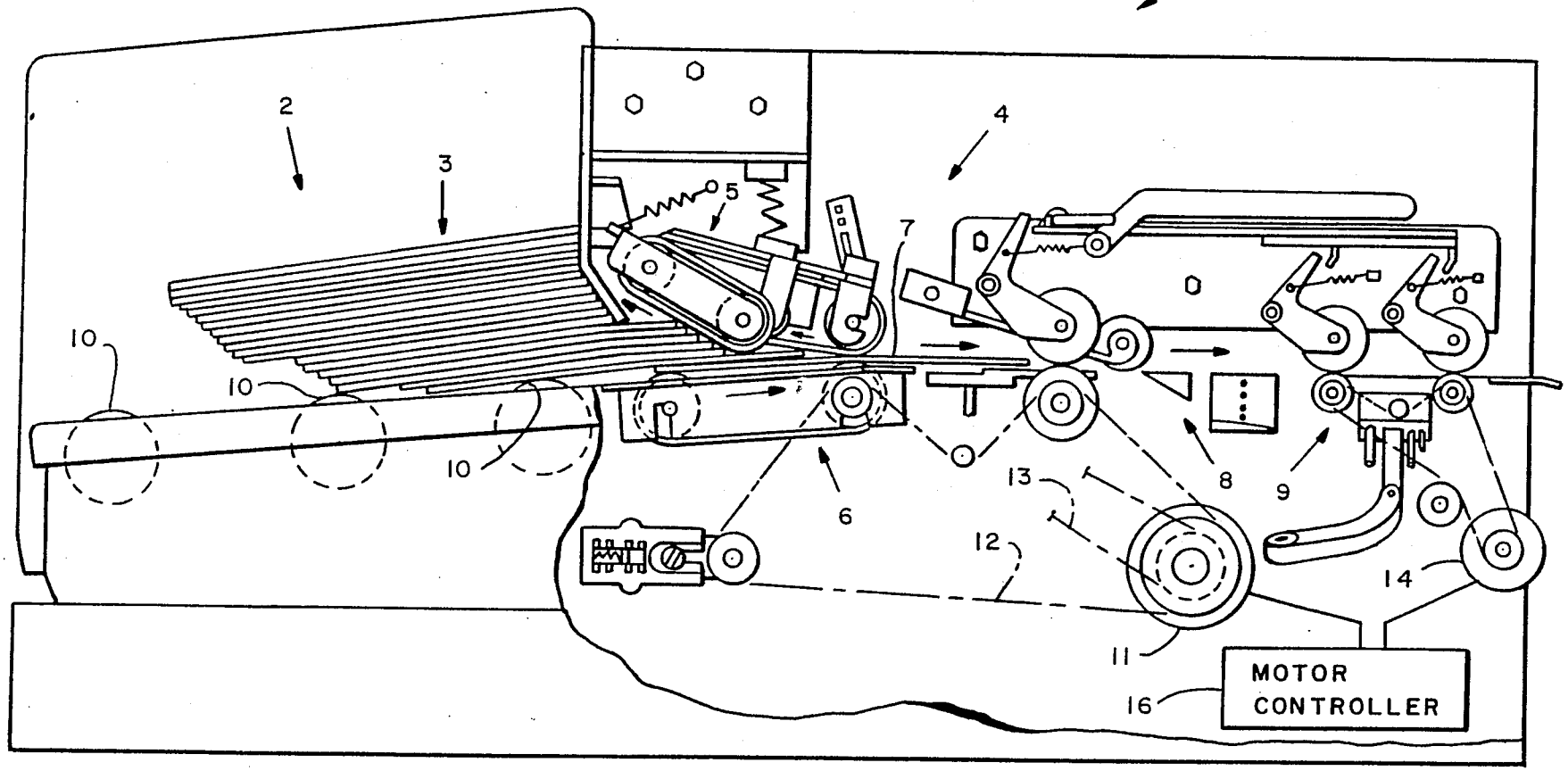
FIG. 1 is a side elevated view of a envelope feed device having a reverse belt singulating apparatus in accordance with the present invention.

Referring to FIG. 1, an envelope feeder, generally indicated as 1, includes an envelope stack station 2 for receiving an envelope stack 3. At the separator station 2, the bottom most envelopes are caused by driven rollers 10 to be received by a singulator station 4. The singulator station 4 is generally comprised of a reverse belt drive assembly 5 and a forward belt drive cartridge 6. From the separator station 2, the bottom most envelope 7 is advanced to a flap separation station 8 by the belt cartridge 6. The envelope 7 is then advanced to a flat moistening station 9 from which the envelope 7 is passed to an adjacent apparatus, such as a mailing machine, for further processing.

A motor 11 is in endless belt 12 communication with the belt cartridge 6 and flap separator station 8 through a suitable power train. A second endless belt 13 provides communication between the motor 11 and the reverse belt assembly 5 in a manner subsequently described. A motor 14 is in endless belt communication with the moistening station 9 through a suitable power train. The separation between successive feeder stations 2, 4, 8 or 9 is less than the length of the smallest envelope processable by the feeder 1. The motors 11 and 14 are under the control of a programmable microprocessor based motor controller 16 in any suitable manner.

Figure 2:
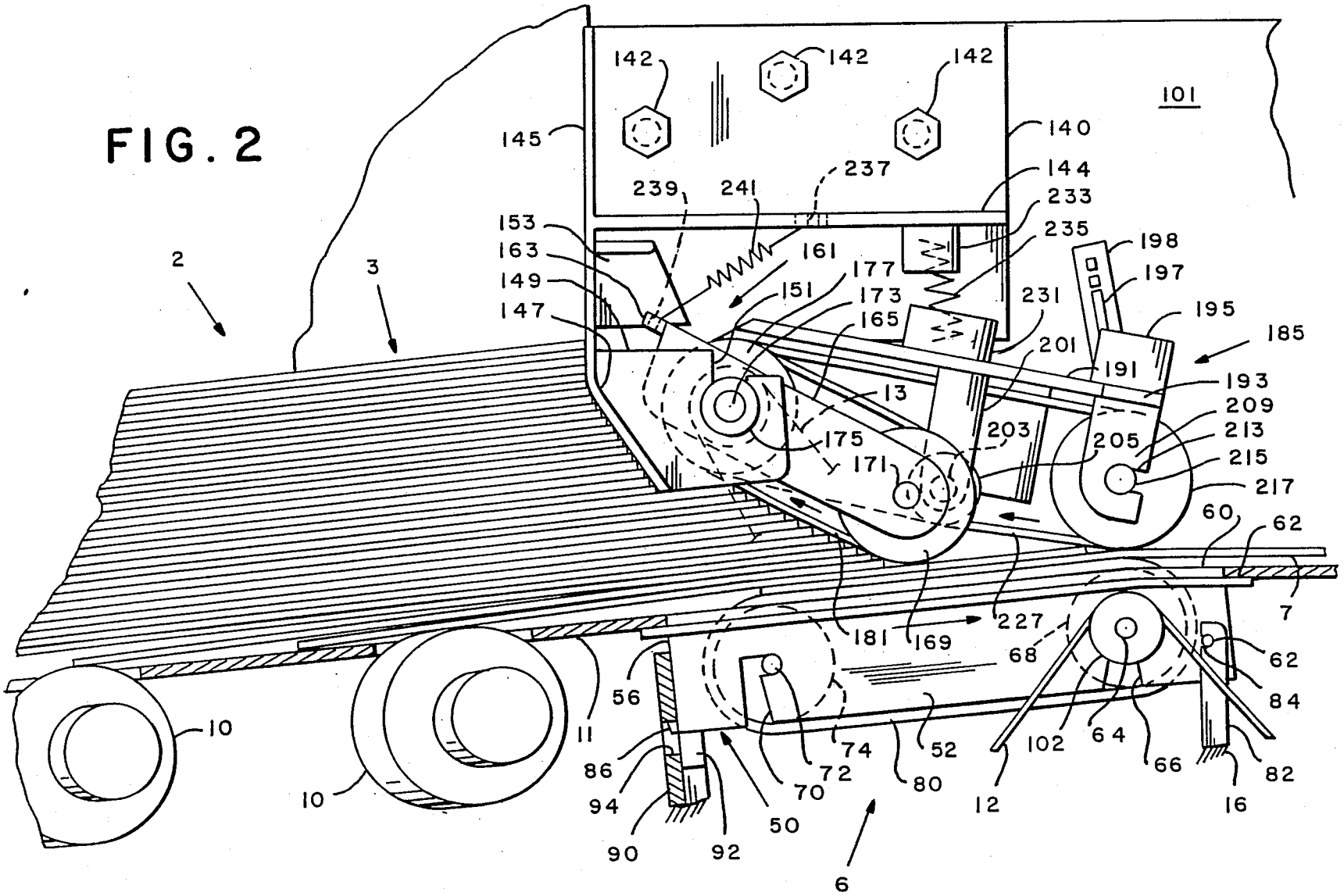
FIG. 2 is a partial side evaluated view of the reverse belt drive assembly in accordance with the present invention.
Figure 3:
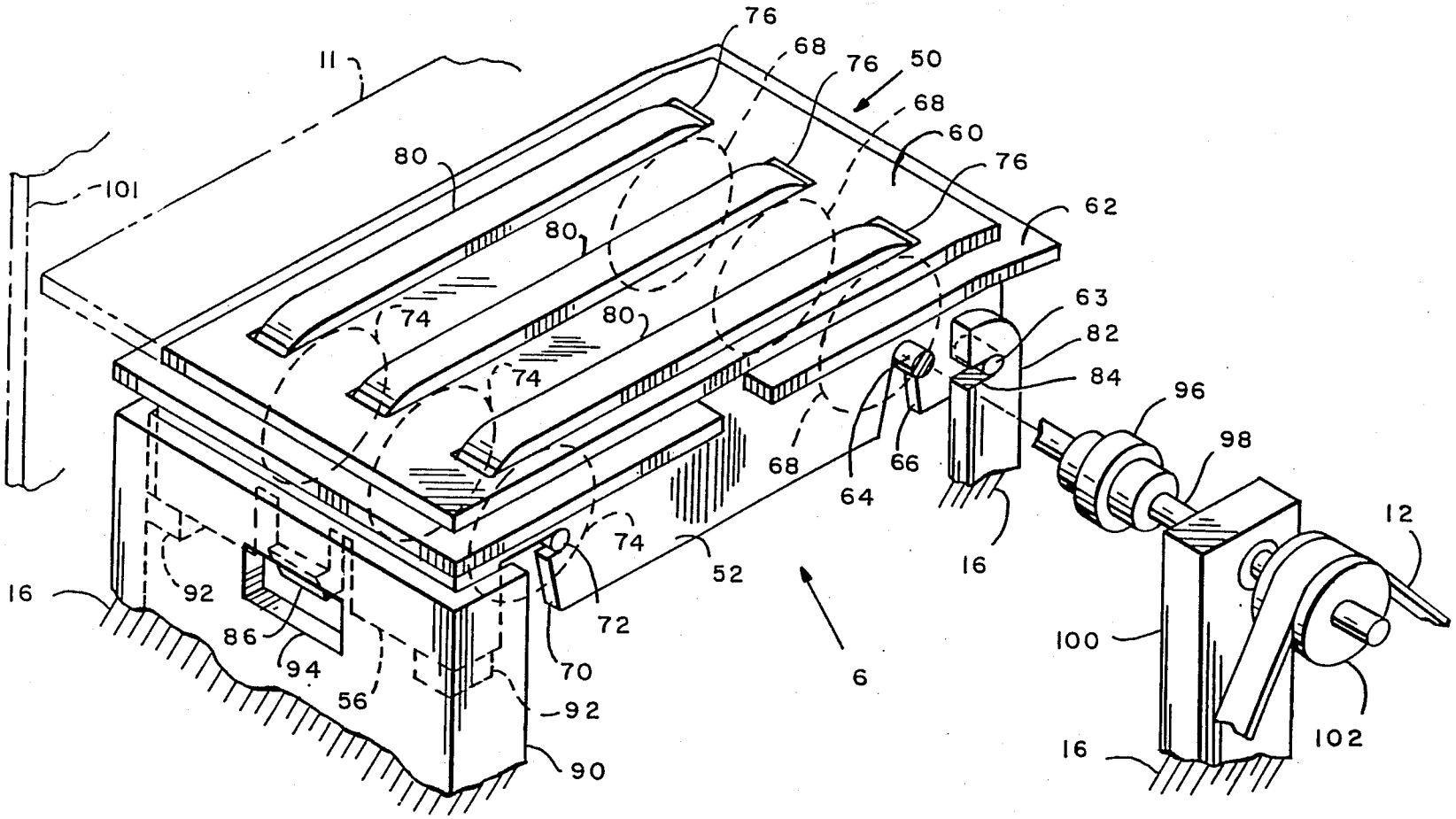
FIG. 3 is an exploded view of a suitable forward belt drive assembly.

Referring more particularly to FIGS. 2 and 3, the belt cartridge 6 is comprised of a housing 50 having spaced apart side wall 52 and end wall 56. A top 60 having a lip 62 formed therearound is fixably mounted to side and end walls 52 and 56. Respective portions of a first shaft 64 is rotatably received in a slot 66 formed in each of the side wall 52. The shaft 64 has drivenly mounted thereto a plurality of rollers 68. The side wall 52 also contain a key slot 70. Received in each key slot 70 is a respective portion of second shaft 72 which shaft 72 contains a plurality of rollers 74 drivenly mounted to the shaft.

The top 60 has formed therein a plurality of longitudinally extending slots 76. Around a respective wheel set 68 and 74 is placed an endless belt 80. Such that the portion of the belt 80 extends through a respective slot 76 slightly above the surface top 60.

The feeder 1 includes first supports 82 outwardly located to respective cartridge wall 52. Each support post 82 includes a reverse C-groove 84 for slidably receiving a respective pin 63 extending from side wall 52. The cartridge end wall 56 includes a clip 86. The other end of the cartridge housing 50 is received in a generally channeled shaped support wall 90 which includes stops 92 on which the cartridge housing 50 rest. The support wall 90 has a opening 94 which interlocks with the clip 86 for locking the belt cartridge 6 in place. The supports 82 and 90 are suitable mounted to the base 16 of the feeder 1.

The shaft 64 has located at one end a coupler 96 of any suitable construction which detachably couples the shaft 64 to a drive shaft 98. The drive shaft 98 is rotatably mounted by any conventional means in a base 16 support wall 100. The other end of the shaft 98 has drivenly mounted thereon a belt wheel 102 around which the drive belt 12 extends.

It is observed that the deck 11 is partially supported by the cartridge housing 50 such that the deck 11 has a opening through which the top 60 of the cartridge extends cartridge lip 62 provides deck support 11. Therefore, removal of the cartridge 50 merely requires lifting off the deck cover 11 and releasing the clip 86 such that the cartridge 50 can be easily withdrawn therefrom. It is noted that placing the belt cartridge 50 at a angle such as four degrees (4°) to the registration wall 101 improves registration of traversing envelopes 7.

Figure 4:
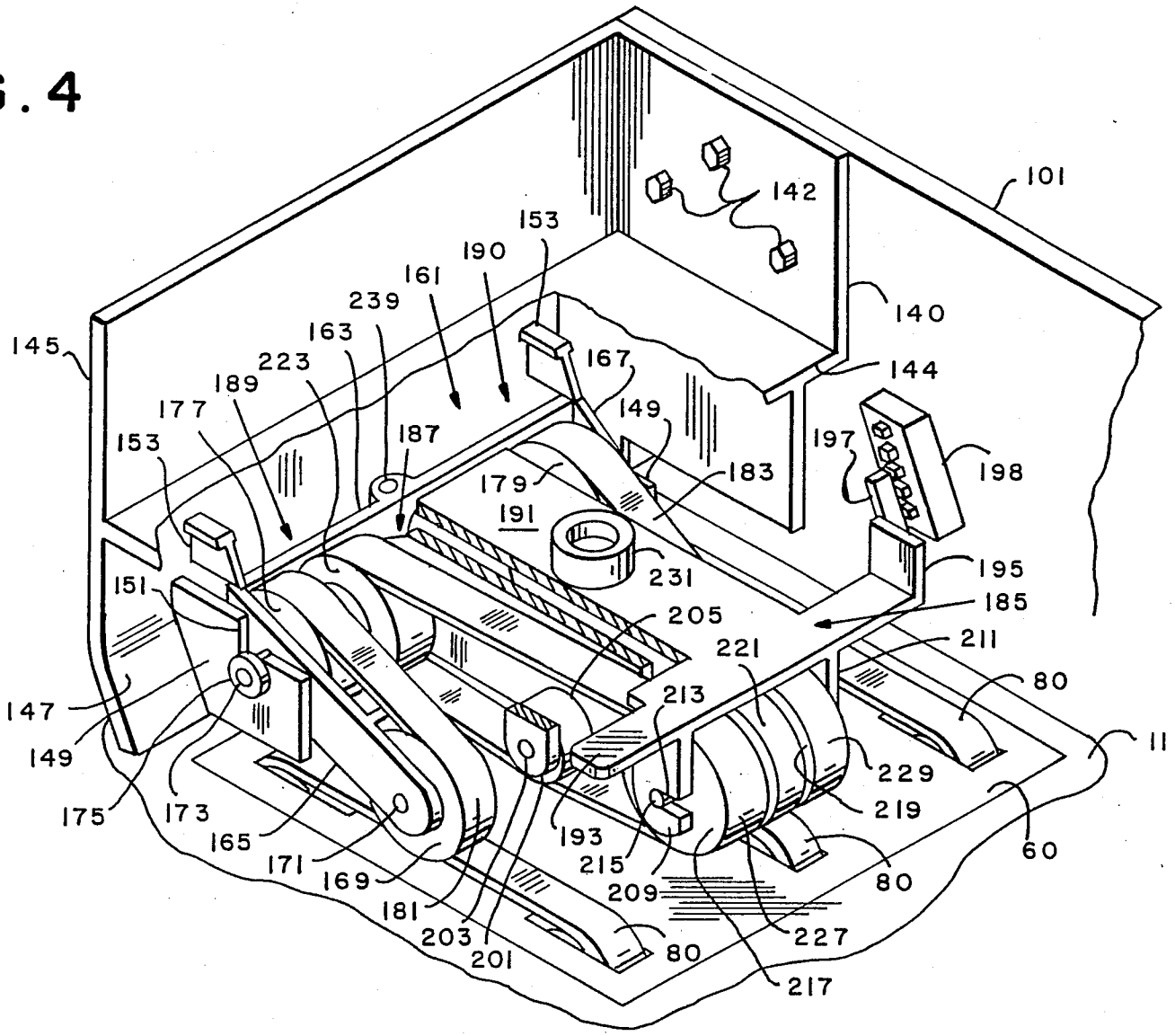
FIG. 4 is an exploded view of the reverse belt drive apparatus in accordance with the present invention.
Figure 5:
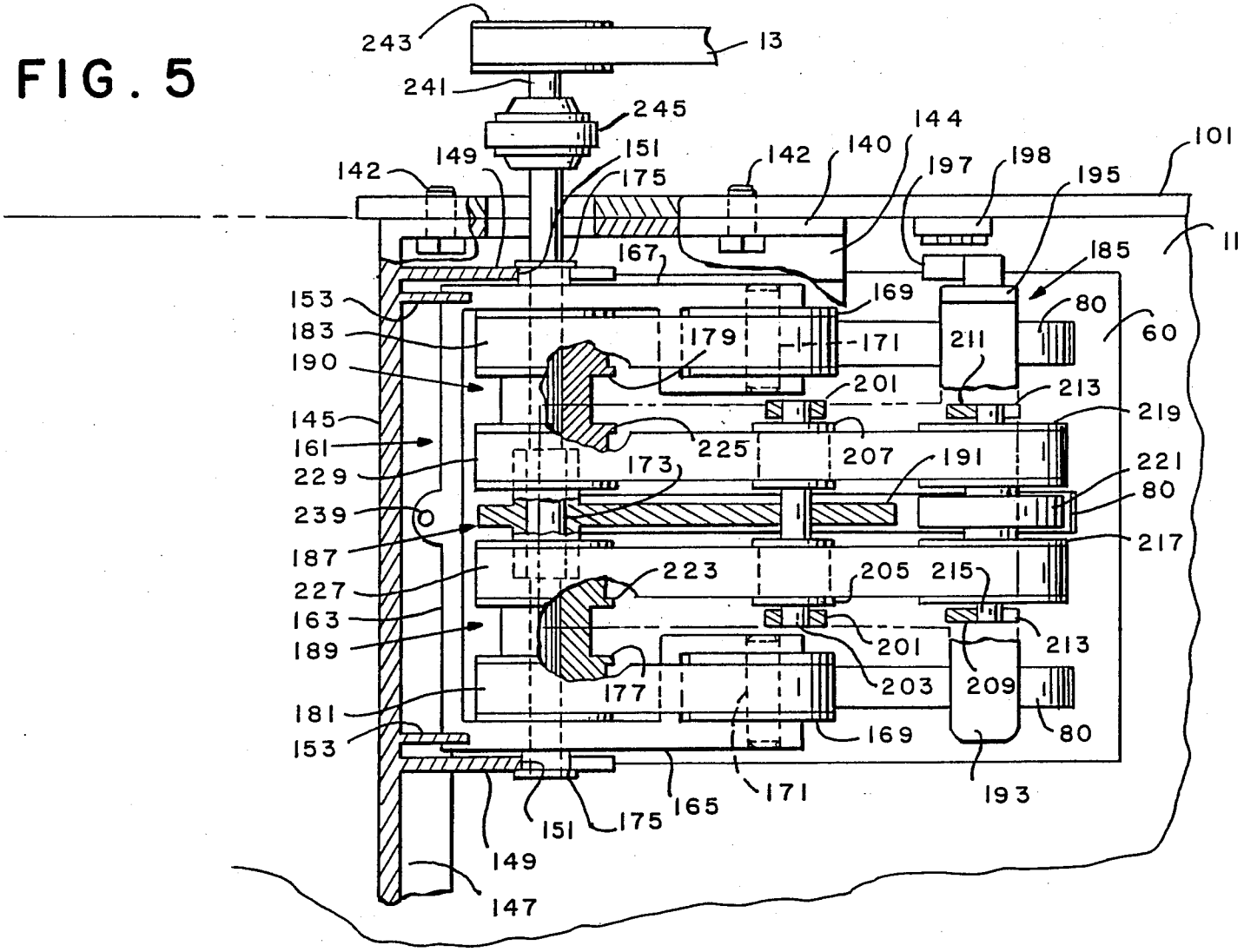
FIG. 5 is a top sectioned view of the reverse belt drive apparatus in accordance with the present invention.

Referring now to FIGS. 2, 4 and 5, a brace 140 is fixably mounted to the registration wall by any conventional means, such as by bolts 142. The brace 140 includes a horizontal extending anchor plate 144 and a facing plate 145 having a angled deflector section 147. Cantilevered from the facing plate 145 are spaced apart shaft support arms 149, each of which includes a key slot 151. Stops 153 are fixably mounted to the facing plate 145.

A belt frame assembly 161 is comprised of a transverse member 163 having yoke side members 165 and 167. Mounted within the respective yoke side members 165 and 167 is a short shaft 171 around which a roller 169 is rotatably mounted. A long shaft 1 73 having bearing member 175 at one end and another bearing member 175 fixed along its length are received in the key slot 151 of the arms 149 to rotatably secure the belt frame assembly 161 to the arms 149. It should be appreciated that herein the bearing member may be any suitable type of bearing member which allows generally free shaft rotation such as silicon bases or such other type of bearing. Drivenly mounted on the long shaft 173 by any conventional means such as a spline engagement are roller hubs 189 and 190 respectively having formed rollers 177 and 179. An endless belt 181 is extended around the rollers 169 and 177 and an endless belt 183 is extended around the rollers 169 and 179.

A second or secondary frame 185 which includes a frame hub 187 is pivotally mounted to the shaft 173, such that the frame hub 187 is pivotally mounted around the shaft 173. To the respective sides of the frame hub 187 is a drive coupler 189 and 190. The drive coupler 189 and 190 is drivenly mounted to the shaft 173 by any conventional means. The frame hub 187 includes a longitudinal member 191 to which a cross sectional member 193 is fixably mounted. At one end of the cross sectional member 193 is a tab 195 having a sensor actuator 197 mounted thereto for cooperatively actuating the sensor bank !98 mounted to the registration wall. Actuation of the sensor bank 198 is responsive to the positioning of the sensor actuator 197 by the frame 185.

The frame longitudinal member 191 also includes mid-support tab 201, such that a short shaft 203 extends between the mid-support tabs 201 and through the longitudinal member 191 to the second mid-support tab 201. Rotatably mounted to the short shaft between the respective mid-support tabs 201 and the longitudinal member 191 are double rim rollers 205 and 207, respectively. Also formed on the cross member 193 are forward support tabs 209 and 211, each support tab 209 and 211 having a C-recess 213 formed therein. A shaft 215 carrYing double rim rollers 217 and 219 with a gage roller 221 spaced in between the double rimmed rollers 217 and 219 are rotatably mounted to the shaft 215 whereby the shaft 215 is received in the C-recess 213.

A hub 189 also includes a formed roller 223 and the hub 190 also includes a formed roller 225. It should be appreciated that rotation of the shaft 173 drives the couplers 189 and 190 and in turn the rollers 223 and 225, respectively. An endless belt 227 is extended between the double rimmed roller 223 and 217 and the roller 205 and endless belt 229 is extended between the double rimmed rollers 225, 207 and 219.

Preformed atop the elongated longitudinal member 191 is a first well 231 which has a spring 235 received therein. The other end of spring 235 is received in a well 233 mounted to the plate 144. A second spring 241 is hooked in an aperture 237 in plate 144 and aperture 239 in member 163.

A shaft 241 including a fixably mounted roller 243 is coupled by conventional coupler 245 to the shaft 173. The motor 11 drives belt 13 which through the roller 243 drives the shaft 173. It should be appreciated that the first frame mounted belt roller assembly provides preshingling to the second belt roller assembly. Further, the preferred invention reduces the normal stack force applied to the bottom most envelope in combination with preshingling has the effect of substantially improving singulating efficiency. In response to displacement of the frame 185 due to passage of an envelope, the sensor bank 198 is actuated by the sensor actuator in a manner representative of the thickness of the displacing envelope. The sensor bank 198 can communicate with the motor controller in any suitable manner to cause the motor controller to suitable vary motor performance.

What is claimed is:

1. A reverse belt drive assembly mounted to a sheetfeeding apparatus having a deck along which sheet members are caused to traverse in a first direction by a drive assembly, comprising:

a first frame pivotally mounted to said apparatus above said deck and drive assembly, said first frame rotatively supporting a first and second roller in longitudinal spaced apart relationship and having an endless belt extending around said first and second rollers;

a second frame pivotally mounted to said first frame, said second frame rotatively supporting a third roller axially aligned to said first roller and a fourth roller in longitudinally spaced apart relationship from said third roller and having an endless belt extending around said third and fourth rollers;

means for biasing said first and second frame members downwardly against said deck; and, means for causing said rollers to rotate and thereby drive said respective belts to act on said sheet members in a direction counter to said first direction.

2. A reverse belt drive assembly as claimed in claim 1 further comprising said sheetfeeding assembly having a sensor bank including a plurality of sensors, said second frame assembly having a sensor actuator means fixably mounted to said frame for actuating said sensor of said sensor bank in a manner characteristically responsive to the thickness of an traversing sheet member.

3. A reverse belt drive assembly as claimed in claim 1 further comprising said sheetfeeding assembly having a sensor bank including a plurality of sensors, said first frame assembly having a sensor actuator means fixably mounted to said frame for actuating said sensor of said sensor bank in a manner characteristically responsive to the thickness of an traversing sheet member.

4. A reverse belt drive assembly as claimed in claims 2 or 3 further comprising means for maintaining the responsive relationship between the sensor bank and actuator means irrespective of variations in the thickness of said endless belts.

5. A reverse belt drive assembly mounted to an envelope feeding apparatus having a deck along which sheet members are caused to traverse in a first direction by drive assembly, comprising:

a first frame pivotally mounted to said apparatus above said deck and drive assembly, said first frame rotatively supporting first and second rollers, respective ones of first and second rollers being in longitudinal spaced apart relationship and having a first endless belt extending around respective ones of said first and second rollers;

a second frame pivotally mounted to said first frame, said second frame rotatively supporting a plurality of third roller axially aligned to said first rollers and a fourth roller being in longitudinally spaced apart relationship to respective third rollers and having a second endless belt extending around respective ones of said third and fourth rollers;

means for biasing said first and second frame members downwardly against said deck; and, means for causing said rollers to rotate and thereby drive said respective belts to act on said sheet members in a direction counter to said first direction.

6. A reverse belt drive assembly as claimed in claim 5 where said drive assembly comprises:

a first and second shaft rotatively mounted to said deck, said deck having a plurality of slots, a plurality of rollers mounted to said first and second shaft, and a plurality of drive endless belts extending around a respective roller on said first and second shaft and journeying along a respective slot.

7. A reverse belt drive assembly as claimed in claim 6 wherein said first endless belt is set at a first angle with respect to the deck and direction of incoming envelopes and said second endless belts are set at a second angle with respect to the deck and direction of incoming envelopes, said second angle being less than said first angle such that said first belts presingle a stack of said envelopes.

8. A reverse belt drive assembly as claimed in claim 7 further comprising a deflection wall fixably mounted to said envelope feeding apparatus upstream of said first frame in vertically spaced apart relationship to said deck.

9. A reverse belt drive assembly as claimed in claim 7 further comprising said second frame having means for causing said second endless belt to extend angularly discontinuing with respect to said drive belts.

10. A reverse belt drive assembly as claimed in claim 7 further comprising said sheetfeeding assembly having a sensor bank including a plurality of sensors, said second frame assembly having a sensor actuator means fixably mounted to said frame for actuating said sensor of said sensor bank in a manner characteristically responsive to the thickness of an traversing sheet member.

11. A reverse belt drive assembly as claimed in claim 10 further comprising said sheetfeeding assembly having a sensor bank including a plurality of sensors, said first frame assembly having a sensor actuator means fixably mounted to said frame for actuating said sensor of said sensor bank in a manner characteristically responsive to the thickness of an traversing sheet member.

12. A reverse belt drive assembly as claimed in claim 11 or 10 further comprising means for maintaining the responsive relationship between said sensor bank and said actuator means irrespective of variations in the thickness of said endless belts.

13. A reverse belt drive assembly as claimed in claim 6 whereby said drive belts as set at a angle between zero degrees (0°) and eight degrees (8°)to a registration wall.

* * * * *